United States Patent [19]

Dahl et al.

[11] 4,420,371

[45] Dec. 13, 1983

[54] ENERGY ABSORBERS FOR VIBRATING HEADBOXES

[75] Inventors: Carl B. Dahl, Rockton, Ill.; Jere W. Crouse, Beloit, Wis.

[73] Assignee: Beloit Corporation, Beloit, Wis.

[21] Appl. No.: 381,899

[22] Filed: May 25, 1982

[51] Int. Cl.[3] ..... D21F 1/02

[52] U.S. Cl. ..... 162/272; 162/336

[58] Field of Search ..... 162/272, 336, 199, 212

[56] References Cited

U.S. PATENT DOCUMENTS 3,487,720 1/1970 Dahl ..... 74/574

4,047,676 9/1977 Dahl et al. ..... 242/66

FOREIGN PATENT DOCUMENTS 328073 12/1926 Fed. Rep. of Germany ..... 162/336

784883 10/1957 United Kingdom ..... 162/336

*Primary Examiner*—Richard V. Fisher

*Attorney, Agent, or Firm*—Hill, Van Santen, Steadman & Simpson

[57] ABSTRACT

The present invention relates to a headbox assembly wherein a headbox is subjected to extraneous vibrational energy from adjoining machinery or the like and provides at least one vibration absorber rigidly secured to the headbox in the plane of vibration of the extraneous vibration, the vibration absorber creating a node at the headbox to absorb vibrational energy transmitted thereto.

7 Claims, 10 Drawing Figures

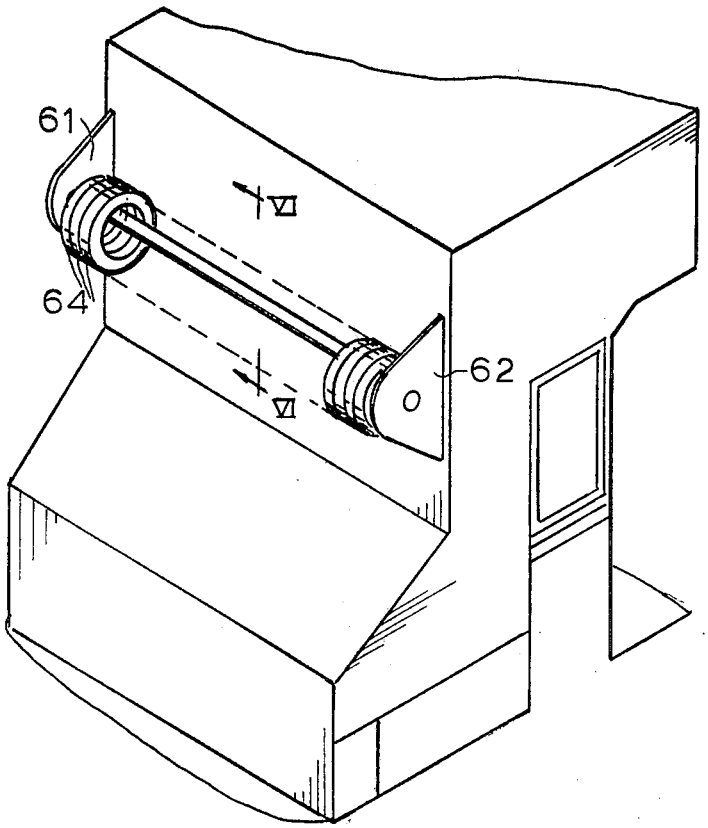
FIG. 5
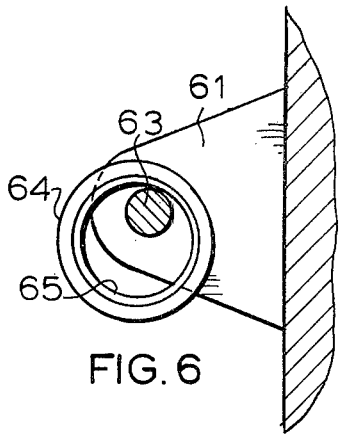
FIG. 6
FIG. 7a
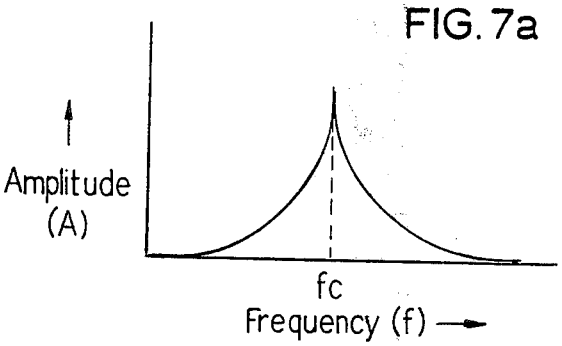
FIG. 7c
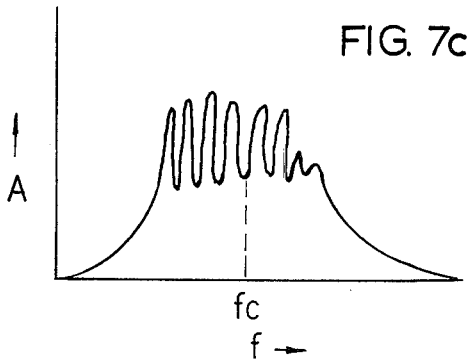
FIG. 7b
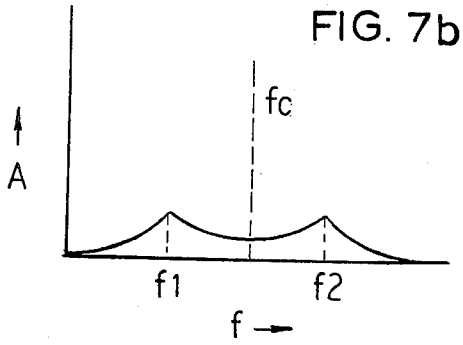
FIG. 7d
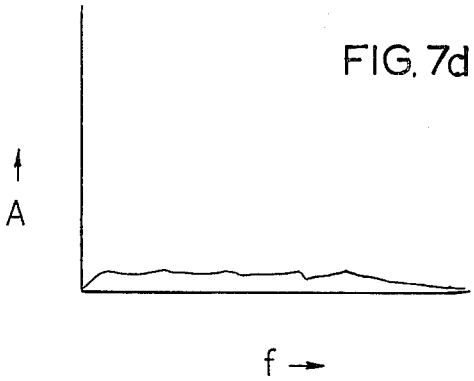

ENERGY ABSORBERS FOR VIBRATING HEADBOXES

BACKGROUND OF THE INVENTION

1. Field of the Invention

The present invention is in the field of energy absorbing devices for headboxes used in the manufacture of paper, which headboxes are subjected to low frequency vibration influences from adjoining machinery and the like.

2. Description of the Prior Art

Variation in the basis weight of paper in the machine direction has always been a serious problem in the production of high quality, fine formation paper sheets. The basis weight variation can result from headbox vibration at forced or natural frequencies, which vibration has been transmitted from sources in the vicinity of the box. The headbox vibration must be eliminated in order to produce high quality, uniform, level, basis weight paper sheet and control the levelness throughout sheet production.

There have been numerous disclosures in the prior art for damping vibrational effects in various portions of the papermaking machinery. For example, in U.S. Pat. No. 3,487,720 in which one of the coapplicants herein was the sole inventor, there is described an energy absorbing device for damping flexural vibration of a rotary boring bar. The device consists of a hollow beam which is insertable within the boring bar in which it is desired to damp flexural vibration. The beam has a visco-elastic tube coiled around its periphery, with one end of the tube being sealed. The other end of the tube is connected to an adjustable air supply consisting of a storage tank contained within the beam and a pressure regulator connected from the tank to the tube to supply air to the tube at a regulated pressure. Metal slats are provided along the periphery of the tube throughout the length of the tube and are loosely placed between the tube and the hollow interior of the boring bar in side-by-side relation with respect to each other. These slats are forced against the inside of the boring bar upon inflation of the tube. The slats may be laminated with a visco-elastic material engaging the inside of the boring bar. Weights are placed along the hollow beam to provide an optimum natural frequency vibration ratio between the beam and the boring bar such that the increments of length of the boring bar subjected to the largest amplitudes of transverse vibration are subjected to the largest damping forces.

In U.S. Pat. No. 4,047,676 the applicants herein described a winder or other rotary mechanism including a rotating member such as a rider roll which is subject to vibrations. An energy absorbing vibration damper was connected to the rider roll, the damper including a stationary hollow tube secured along its length to a beam coextensive with the rider roll and a beam member within the stationary tubular member having a resilient hose coiled thereabout. The hose is inflated and a plurality of axially extending metal slats are positioned between the inflatable tube and the inside of the tubular member, the slats being laminated with a visco-elastic material for absorbing vibration of the rider roll.

SUMMARY OF THE INVENTION

The present invention provides an improved headbox assembly which has means for absorbing vibrational energy at the headbox. The present invention is concerned with the provision of broad band, tuned or frequency independent dynamic vibration absorbers to a headbox to eliminate serious vibration which would otherwise cause machine direction basis weight variations. It is entirely possible, during the operation of a headbox, to locate the headbox in the presence of mechanical vibration which is within the frequency range present from the natural frequencies of structural elements in the headbox. The headbox has several rigid body vibration natural frequencies in translational and rotational modes as well as several deflection natural frequencies. These natural frequencies are highly dependent on the mounting boundary condition of the box. Vibration excitation sources can operate at frequencies close to these natural frequencies and can transmit the vibration to the headbox either through fluid streams or through the mechanical structure itself.

It is possible to measure accurately the mechanical vibrational frequency which is predominating. This is accomplished by means of observing the fiber lay on the sheet. When the fiber lay is disturbed by extraneous vibrational sources, uneven deposits are produced on the sheet, resulting in bars extending across the width of the sheet. The frequencies appearing in the headbox can be determined optically by measuring the spacings of these bars.

The vibration from vibratory sources does not necessarily excite the headbox at a natural frequency. The vibration can be forced rigid body motion. It is accordingly not necessary to provide for critical damping of the vibration excitation or very limited damping. The best results are achieved when the damping characteristic is somewhere between the two. The important characteristic is that the dynamic absorber which is applied to the headbox causes a node at the box and thus absorbs energy even at forced vibrational frequencies.

In accordance with the present invention, at least one vibration absorber is rigidly secured to the headbox in the plane of vibration of the extraneous vibration. The vibration absorber may be tuned to the fundamental frequency of the vibrational energy or may be an untuned, broad band absorber or it may be a frequency independent absorber. In the preferred embodiment of the invention, the vibration absorber is in the form of a tuned mass spring consisting of a mass free to oscillate between a pair of resilient cushioning blocks.

In a particularly preferred embodiment of the invention, there is provided a plurality of spaced, tuned mass springs, one tuned mass spring being tuned to the fundamental frequency of the vibrational energy and the others being tuned to side band frequencies created by modulation of the one tuned mass spring.

In another form of the invention, the vibration absorber may comprise a rod which is rigidly secured to the headbox, and a plurality of rings carried loosely by the rod, the inner surfaces of the rings being lined with a friction material.

BRIEF DESCRIPTION OF THE DRAWINGS

A further description of the present invention will be made in conjunction with the attached sheets of drawings which illustrate several preferred embodiments thereof:

FIG. 5 is a view in perspective of a portion of a headbox showing a still further modified form of the invention;

FIG. 6 is a cross-sectional view taken substantially along the line VI—VI of FIG. 5; and FIGS. 7*a* through 7*d* are graphs plotting amplitude versus frequency and illustrating the principles of the present invention.

DESCRIPTION OF THE PREFERRED EMBODIMENTS

Figure 1:
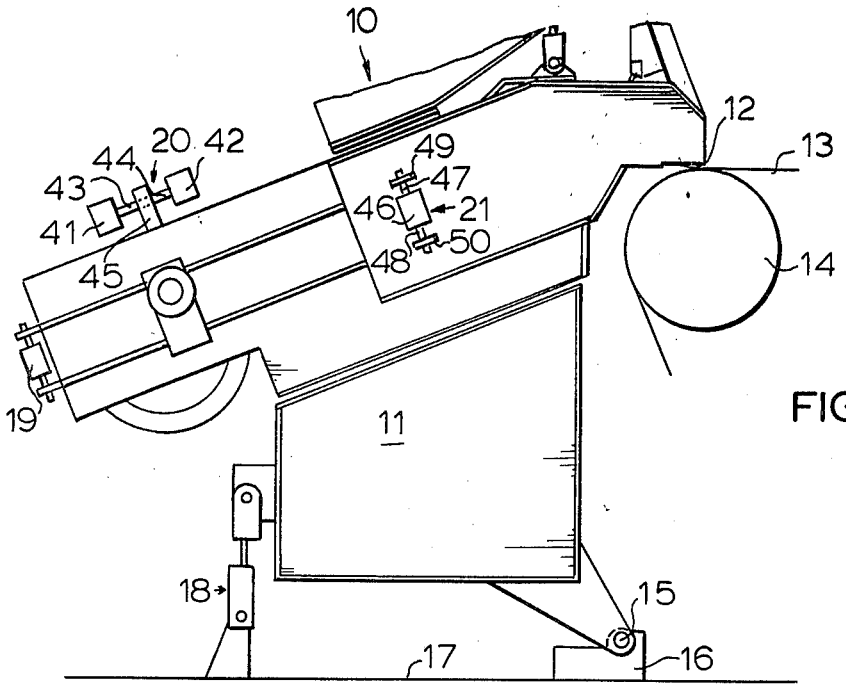
FIG. 1 is a view in elevation of a headbox assembly which is provided with the improvements of the present invention.

In FIG. 1, there is illustrated a headbox assembly of the pivoting type although it should be realized that the vibration absorbing mechanism of the present invention can be used in conjunction with any type of headbox structure which is subject to extraneous vibration.

In a particular form of the invention shown in FIG. 1, there is provided a headbox assembly generally indicated at reference numeral 10 consisting of a hydraulic headbox chamber 11 and a stock discharge chamber which terminates in a slice 12 which applies the fiber suspension to a traveling wire 13 trained around a roll 14. The headbox structure is mounted for pivotal movement about a pivot shaft 15 which is anchored to a block 16 secured to a floor 17. Limited pivotal movement is provided about the axis of the shaft 15 by means of a jack 18 secured to the floor 17.

The type of headbox assembly shown in FIG. 1 is subject to various types of vibration in various planes. There is vibration which is carried through the hydraulic system in the machine direction, and other vibrational sources which have to be compensated for in the cross machine direction. Another source of vibration is present from the rocking of the headbox about its pivot.

To diminish the adverse effect of these various vibrational energy sources on the fiber deposition, the headbox assembly of FIG. 1 is provided with three sets of vibration absorbers. The first set, illustrated at the rear of the machine at reference numeral 19, is used to counteract vibration in the machine direction. A second vibration absorber means illustrated at reference numeral 20 is provided to compensate for vibration in the vertical plane while a third vibration absorber generally indicated at reference numeral 21 is provided to adjust for vibration in the horizontal cross machine direction.

Figure 2:
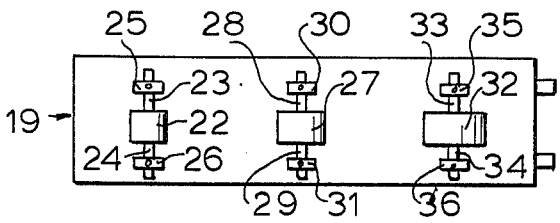
FIG. 2 is a rear elevational view of the structure shown in FIG. 1.

The vibration absorber for the machine direction vibration is illustrated more specifically in FIG. 2. As shown in this Figure, there is provided a series of three vibration absorbers tuned to different frequencies. The first consists of a weight 22 connected to a pair of resilient supports 23 and 24 which in turn are held by means of brackets 25 and 26. The central vibration absorber may include a slightly larger weight 27 connected to a pair of resilient supports 28 and 29 which are held in place between brackets 30 and 31. Finally, there is the third vibration assembly consisting of an even larger mass 32 connected to a pair of resilient supports 33 and 34 between a pair of brackets 35 and 36. This end assembly is illustrated in more detail in the showing of FIG. 3. As seen in that Figure, the resilient supports 33 and 34 are positioned within the brackets 35 and 36 by means of set screws 37 and 38, respectively.

The combination of the weight 32 and the resilient supports 33 and 34 effectively form a spring and dashpot assembly capable of absorbing vibrational energy over a limited frequency range.

Referring to FIG. 7*a*, there is shown an idealized situation in which the amplitude of vibration of the headbox peaks at a single frequency, $f_c$. By applying a single vibration absorber tuned to $f_c$, two side bands are produced, frequencies $f_1$ and $f_2$, as illustrated in FIG. 7*b*. The frequencies of the side bands depend on the mechanical characteristics of the absorber used. In any event, the amplitude of vibration is reduced to a tolerable level.

In practice, however, the headbox is generally vibrating at similar amplitudes at several frequencies in a fairly narrow frequency band as illustrated in FIG. 7*c*. Now, if there are provided three absorbers, the first of which is tuned to the center frequency, $f_c$, and the others tuned to the theoretical side band frequencies $f_1$ and $f_2$ known to be produced by the absorber, the amplitude of vibration will be reduced very substantially, as shown in FIG. 7*d* so that vibration is no longer a problem.

Returning to FIG. 2, it is therefore feasible to tune the middle vibration absorber assembly including the weight 27 to the fundamental frequency, tuning the vibration absorber at the left to a lower side band or difference frequency, and that to the right to a higher side band or sum frequency.

Figure 3:
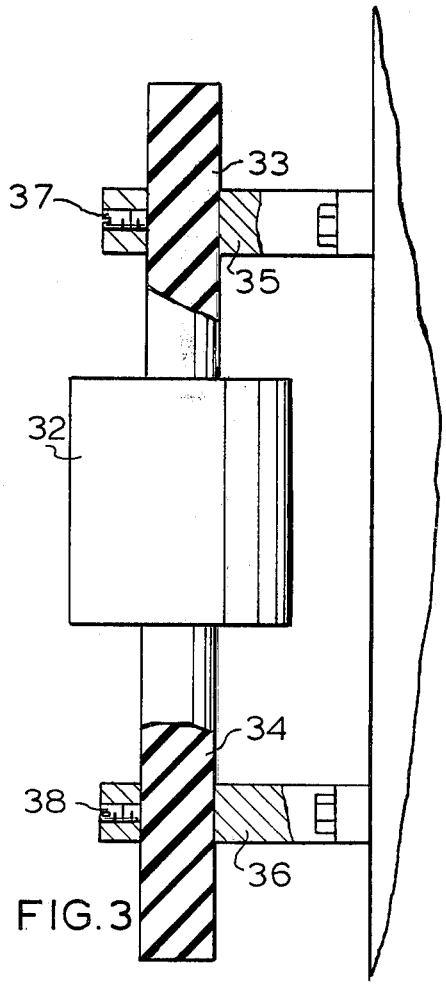
FIG. 3 is a view partly in elevation and partly in cross section on an enlarged scale illustrating the type of damping means employed in FIGS. 1 and 2.

Tuning of the structure shown in FIGS. 2 and 3 is accomplished by either changing the amount of the mass or by changing the effective length of the resilient supports 33 and 34, for example. These supports are made of an elastic material such as butyl rubber or neoprene since these materials serve not only as springs but also serve to absorb some vibration in themselves.

Returning to FIG. 1, the vibration absorbing assembly 20 is oriented to absorb vibration in the vertical direction. It makes use of a pair of weights 41 and 42 which are supported on resilient supports 43 and 44 which are themselves rigidly secured to a support bracket 45 fixedly secured to the top of the headbox structure.

Similarly, the vibration absorber 21 may consist of a set of one more vibration absorbers containing a weight 46 mounted on a pair of resilient supports 47 and 48 mounted between support brackets 49 and 50. Each of these vibration absorbers can be tuned to a fundamental frequency which is characteristic of the vibrational energy occuring in the plane in which the vibration absorber is located.

Figure 4:
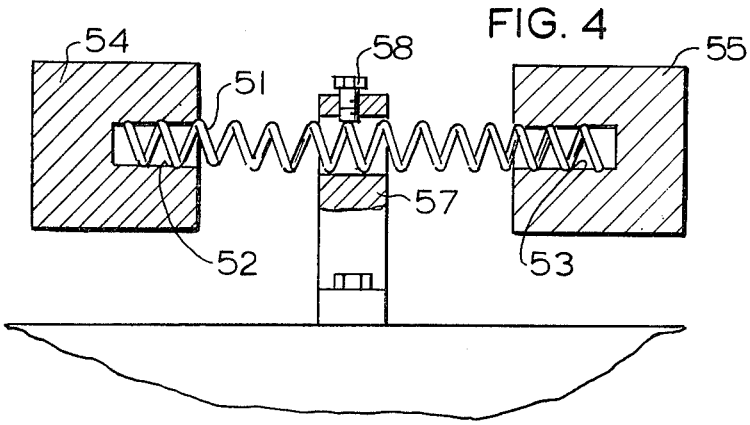
FIG. 4 is a view partly in elevation and partly in cross section illustrating a modified form of the present invention.

A modified form of the present invention is illustrated in FIG. 4 of the drawings. This form makes use of a helical spring 51 which is confined within threaded bores 52 and 53, respectively, located in a pair of weights 54 and 55. The spring is confined within a mounting bracket 57 by means of a set screw 58. The effective length of the spring 51 can be varied by threading the end of the spring to a greater or lesser degree within the threaded bore 52. This effectively changes the dynamic characteristics of the vibration assembly in the same manner as adjusting the length of the resilient support of the embodiments previously described.

A still further modified form of the present invention is illustrated in FIGS. 5 and 6 of the drawings. In the fragmentary view shown in FIG. 5, there is illustrated a frequency independent absorber including a pair of brackets 61 and 62 rigidly secured to the back of the headbox structure. A rod 63 is mounted in rigid relationship between the brackets 61 and 62. A series of rings 64 is mounted in relatively loosely fitting relationship about the rod 63. As best illustrated in FIG. 6, each of the rings 64 has an inner diameter which is coated with a friction material 65. In operation, as the headbox vibrates, the rings 64 slowly rotate about the rod 63, thus dissipating energy by friction between the rod 63 and the rings 64 as well as any friction occurring between any two contacting surfaces of the rings. This provides a friction damping action which effectively absorbs vibrational energy from the extraneous source.

It should be understood from the foregoing that the present invention provides an improved energy absorber for vibrating headboxes which significantly decreases the amount of such vibrational energy transmitted to the fiber dispersion being deposited on the forming means.

It should also be evident that various modifications can be made to the described embodiments without departing from the scope of the present invention.

We claim as our invention:

1. In a headbox assembly wherein a headbox is subject to extraneous vibrational energy from adjoining machinery or the like, the improvement which comprises:

at least one vibration absorber rigidly secured to said headbox in the plane of vibration of said extraneous vibration, said vibration absorber creating a node at said headbox to absorb vibrational energy transmitted thereto.

2. A headbox assembly according to claim 1 in which: said vibration absorber is tuned to the fundamental frequency of said vibrational energy.

3. A headbox assembly according to claim 1 in which: said vibration absorber is an untuned, broad band absorber.

4. A headbox assembly according to claim 1 in which: said vibration absorber is a frequency independent absorber.

5. A headbox assembly according to claim 1 in which: said vibration absorber is a tuned mass spring.

6. A headbox assembly according to claim 5 which includes a plurality of spaced tuned mass springs, one tuned mass spring being tuned to the fundamental frequency of said vibrational energy and the others being tuned to side band frequencies created by modulation of said one tuned mass spring.

7. A headbox according to claim 1 in which: said vibration absorber comprises:

a rod rigidly secured to said headbox, and a plurality of rings carried loosely by said rod, the inner surfaces of said rings being lined with a friction material.

* * * * *